US006508293B1

(12) United States Patent
Huang

(10) Patent No.: US 6,508,293 B1
(45) Date of Patent: Jan. 21, 2003

(54) SPRING MOTOR ASSEMBLY FOR A VENETIAN BLIND WITHOUT OUTSIDE HANGING LIFTING CORDS

(76) Inventor: Tai-Long Huang, No. 382, Yuan-Lu Rd., Sec. 1, Fuhsing, Changhua (TW)

( * ) Notice: Subject to any disclaimer, the term of this patent is extended or adjusted under 35 U.S.C. 154(b) by 0 days.

(21) Appl. No.: 09/948,304

(22) Filed: Sep. 6, 2001

(51) Int. Cl.[7] ..... E06B 3/322
(52) U.S. Cl. ..... 160/170 R; 160/173 R
(58) Field of Search ..... 160/170 R, 168.1 R, 160/171 R, 172 R, 84.02, 84.04, 84.06, 191, 192, 193; 267/155, 156; 185/37, 39, 45

(56) References Cited

U.S. PATENT DOCUMENTS 13,251 A * 7/1855 Bixler ..... 160/170 R
5,170,830 A * 12/1992 Coslett ..... 160/192 X
5,482,100 A 1/1996 Kuhar ..... 160/170
6,024,154 A * 2/2000 Wang et al. ..... 160/170 R
6,056,036 A * 5/2000 Todd et al. ..... 160/84.05
6,079,471 A * 6/2000 Kuhar ..... 160/170 R
6,095,222 A * 8/2000 Voss ..... 160/84.05
6,149,094 A * 11/2000 Martin et al. ..... 160/192 X
6,283,192 B1 * 9/2001 Toti ..... 160/170 R
6,289,965 B1 * 9/2001 Ruggles ..... 160/170 R
6,293,329 B1 * 9/2001 Toti ..... 160/170 R
6,330,899 B1 * 12/2001 Ciuca et al. ..... 160/170 R

* cited by examiner

*Primary Examiner*—David M. Purol
(74) *Attorney, Agent, or Firm*—Ohlandt, Greeley, Ruggiero & Perle, L.L.P.

(57) ABSTRACT

A spring motor assembly for a Venetian blind includes a bracket formed with confronting insert grooves, a pair of insert plates inserted into the insert grooves, two parallel axles extending transversely between the insert plates, a storage drum mounted rotatably on one of the axles, co-axial and co-rotatable output drum and cord spool mounted rotatably on the other of the axles, and a coil spring extending between the storage drum and the output drum. The bracket is mounted on a top rail of the Venetian blind. The cord spool engages upper ends of two lifting cords of the Venetian blind. The coil spring is wound on at least one of the storage drum and the output drum, and is transferred from one of the drums to the other of the drums when a bottom bar of the Venetian blind is moved upwardly or downwardly relative to the top rail.

4 Claims, 5 Drawing Sheets

SPRING MOTOR ASSEMBLY FOR A VENETIAN BLIND WITHOUT OUTSIDE HANGING LIFTING CORDS

BACKGROUND OF THE INVENTION

1. Field of the Invention

The present invention relates to a spring motor assembly for use in a Venetian blind that has no outside hanging lifting cords, more particularly to a spring motor assembly that provides a driving force for driving raising or lowering movement of slats of the Venetian blind.

2. Description of the Related Art

U.S. Pat. No. 5,482,100 discloses a Venetian blind without outside hanging lifting cords. The Venetian blind has a spring motor mounted on a top rail thereof. The spring motor is coupled to a pair of lifting cords of the Venetian blind, and provides driving forces for raising or lowering a plurality of horizontal slats that are suspended from the top rail. The spring motor includes a bracket having a back wall and a pair of side walls that extend transversely from the back wall and that cooperate with the back wall to form the bracket with a generally U-shaped configuration. The bracket further has a pair of attached plates on the side walls for fastening to the top rail. Two axles are secured onto the back wall for mounting a spring storage drum, a spring output drum and a cord spool that is co-axial and co-rotatable with the output drum. The lifting cords extend through the slats, and have lower ends connected to a bottom bar and upper ends coupled to the cord spool.

A coil spring has a first end coupled to the storage drum and an opposite second end coupled to the output drum, and is transferred from one of the drums to the other of the drums when the bottom bar moves with respect to the top rail.

When the slats are raised, the weights thereof are applied to the lifting cords, and in turn, to the cord spool and the axle that supports the cord spool. Since the axles are each connected to the bracket at only one end thereof, they are susceptible to vibration due to the weights of the slats applied thereon during operation for raising or lowering the slats, thereby adversely affecting smooth raising and lowering movement of the slats. Moreover, as the axles are fastened to the back wall by screws or rivet, loosening of the axles from the back wall is likely to occur.

SUMMARY OF THE INVENTION

Therefore, the main object of the present invention is to provide a spring motor assembly of the aforementioned type and with a firmer and more stable construction to ensure smooth raising and lowering movement of Venetian blind slats.

Accordingly, the spring motor assembly of the present invention is adapted for use in a Venetian blind that includes a top rail, a plurality of horizontal slats suspended from the top rail, a horizontal bottom bar disposed below the slats, and a pair of lifting cords, each of which extends through the slats and has an upper end extending into the top rail and a lower end connected to the bottom bar. The spring motor assembly of the present invention includes a bracket, a pair of insert plates, parallel first and second axles, a storage drum, an output drum, a cord spool, and a coil spring. The bracket is adapted to be installed on the top rail, and includes parallel front and back walls, and a pair of lateral side walls interconnecting the front and back walls and cooperating with the front and back walls to confine a receiving chamber with a top opening. Each of the front and back walls has an inner wall surface that confronts the other of the front and back walls. The front and back walls further have upper edges that define the top opening. The inner wall surface of each of the front and back walls is formed with an insert groove that extends downwardly from the upper edge and that has an open upper end formed through the upper edge. Each of the lateral side walls is formed with a cord opening communicated with the receiving chamber and adapted to permit extension of a respective one of the lifting cords therethrough. Each of the insert plates is inserted into the insert groove in a respective one of the front and back walls via the open upper end, and is retained therein. The first and second axles are mounted on the insert plates and extend transversely between the insert plates. The storage drum is mounted rotatably on the first axle. The output drum is mounted rotatably on the second axle. The cord spool is mounted rotatably on the second axle so as to be co-rotatable with the output drum. The cord spool is adapted to engage the upper ends of the lifting cords and to permit winding of the lifting cords therearound. The coil spring has a first end engaging the storage drum, and a second end opposite to the first end and engaging the output drum. The coil spring is wound around at least one of the storage drum and the output drum, and is transferred from one of the storage drum and the output drum to the other of the storage drum and the output drum when the bottom bar of the Venetian blind is moved with respect to the top rail in a vertical direction.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
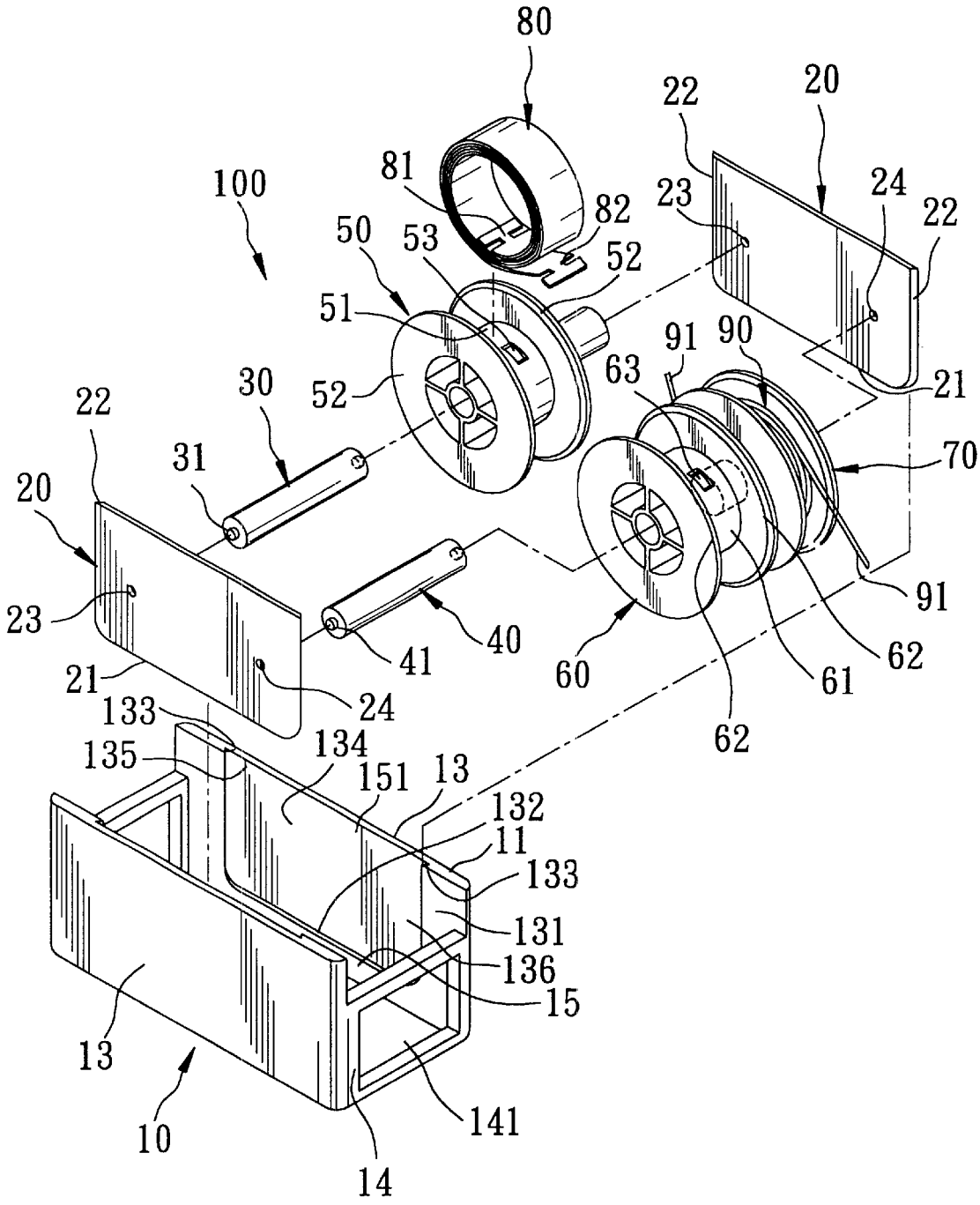
FIG. 1 is an exploded perspective view of a preferred embodiment of a spring motor assembly of the present invention.
Figure 2:
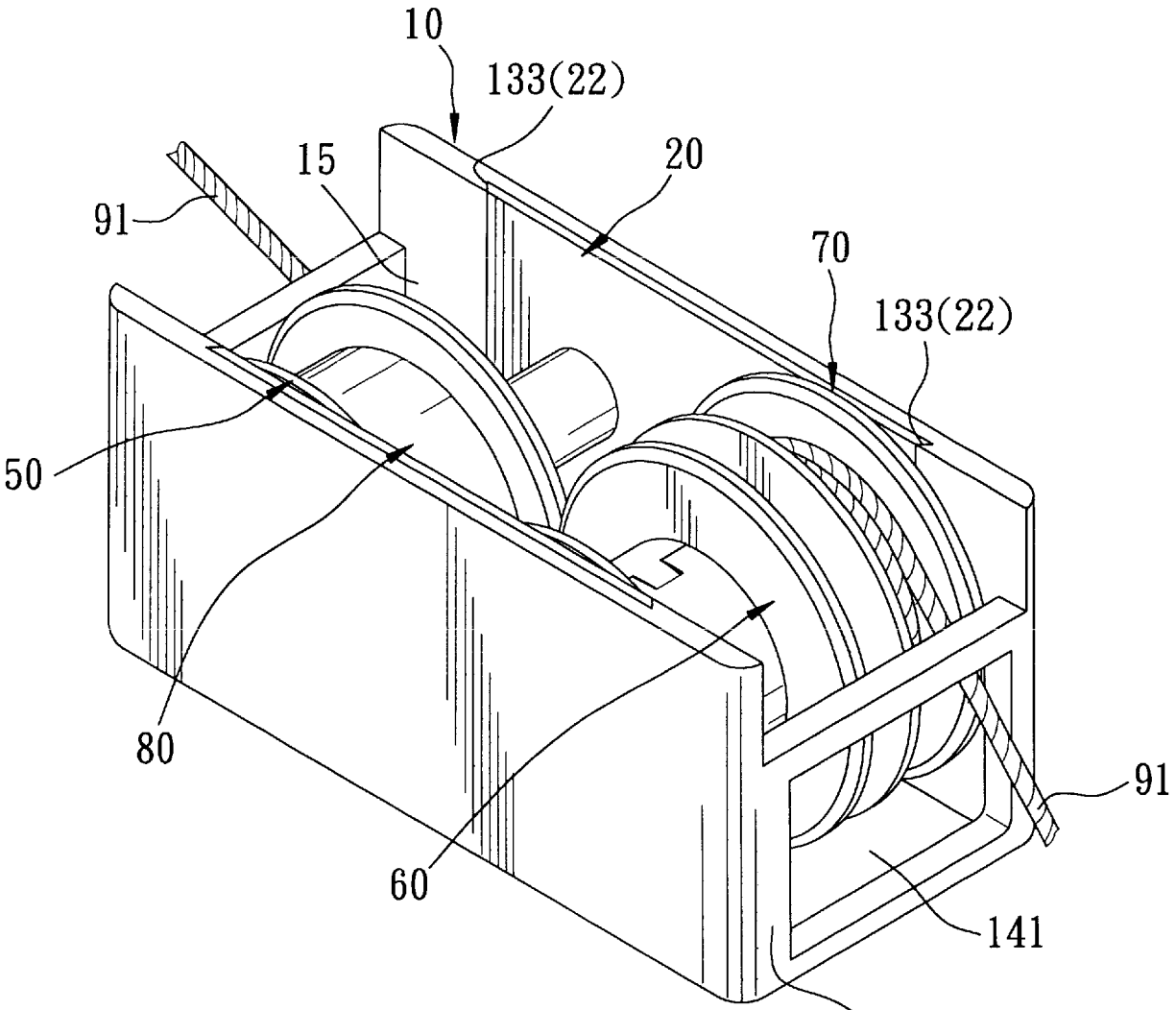
FIG. 2 is an assembled perspective view of the preferred embodiment.

Referring to FIGS. 1 and 2, the preferred embodiment of the springmotor assembly 100 of the present invention is shown to include a bracket 10, a pair of insert plates 20, parallel first and second axles 30, 40, a storage drum 50, an output drum 60, a cord spool 70, and a coil spring 80.

The bracket 10 is formed as a hollow rectangular casing, and includes upright front and back walls 13 disposed parallel to each other, and a pair of side walls 14 interconnecting lateral ends of the front and back walls 13 and cooperating with the front and back walls 13 to confine a receiving chamber 15 that has a top opening 151. Each of the side walls 14 is formed with a rectangular cord opening 141 communicated with the receiving chamber 15. Each of the front and back walls 13 has an inner wall surface 131 which confronts the other of the front and back walls 13 and which is formed with an insert groove 134 that extends downwardly from an upper edge 11 of the respective one of the front and back walls 13 and that has an open upper end 135 formed through the upper edge 11 and communicated with the top opening 151 of the receiving chamber 15. The insert groove 134 is in the form of a dovetail groove with a narrower end proximate to the other of the front and back walls 13 and communicated with the receiving chamber 15, and a wider end distal to the other of the front and back walls 13. The insert groove 134 in each of the front and back walls 13 is defined by a pair of spaced apart inclined lateral faces 133, a connecting face 136, and a horizontally extending bottom face 132. The lateral faces 133 extend downwardly from the upper edge 11 of the respective one of the front and back walls 13, and have upper ends defining the open upper end 135 of the insert groove 13, inner ends defining the narrower end of the dovetail groove 134, and outer ends defining the wider ends of the dovetail groove 134. The connecting face 136 extends between the outer ends of the lateral faces 133. The bottom face 132 faces upwardly and extends between lower ends of the lateral faces 133.

Each of the insert plates 20 is inserted into the insert groove 134 in a respective one of the front and back walls 13 via the open upper end 135 of the insert groove 134, and has a size and shape conforming with those of the insert groove 134. Each of the insert plates 20 has a bottom edge 21 abutting against the bottom face 132 of the insert groove 134, and lateral edges 22 engaging the lateral faces 133 of the insert groove 134. The insert plates 20 are formed with aligned first axle holes 23, and aligned second axle holes 24.

The first axle 30 is mounted on the insert plates 20 by extending a pair of pin projections 31 formed at two opposite ends thereof into the first axle holes 23 in the insert plates 20. The second axle 40 is mounted on the insert plates 20 by similarly extending a pair of pin projections 41 formed at two opposite ends thereof into the second axle holes 24 in the insert plates 20.

The spring storage drum 50 has a cylindrical body 51 sleeved rotatably on the first axle 30, and a pair of annular walls 52 cooperating with the cylindrical body 51 to define a spring storage space for storing the coil spring 80. The cylindrical body 51 has an outer surface formed with a first engaging hole 53 for engaging a first end 81 of the coil spring 80.

The output drum 60 is connected co-axially and co-rotatably to the cord spool 70. In the present embodiment, the output drum 60 is formed integrally with the cord spool 70. The assembly of the output drum 60 and the cord spool 70 is sleeved rotatably on the second axle 40 such that the output drum 60 is juxtaposed to the storage drum 50. The output drum 60 similarly has a cylindrical body 61 extending transversely between a parallel pair of annular walls 62 so as to cooperatively confine a spring receiving space. The cylindrical body 61 is formed with a second engaging hole 63 in its outer surface for engaging a second end 82 of the coil spring 80 opposite to the first end 81. The cord spool 70 is adapted to engage upper ends of a pair of lifting cords of a Venetian blind, and confines an annular cord winding space adapted to permit winding of the lifting cords therearound.

Figure 3:
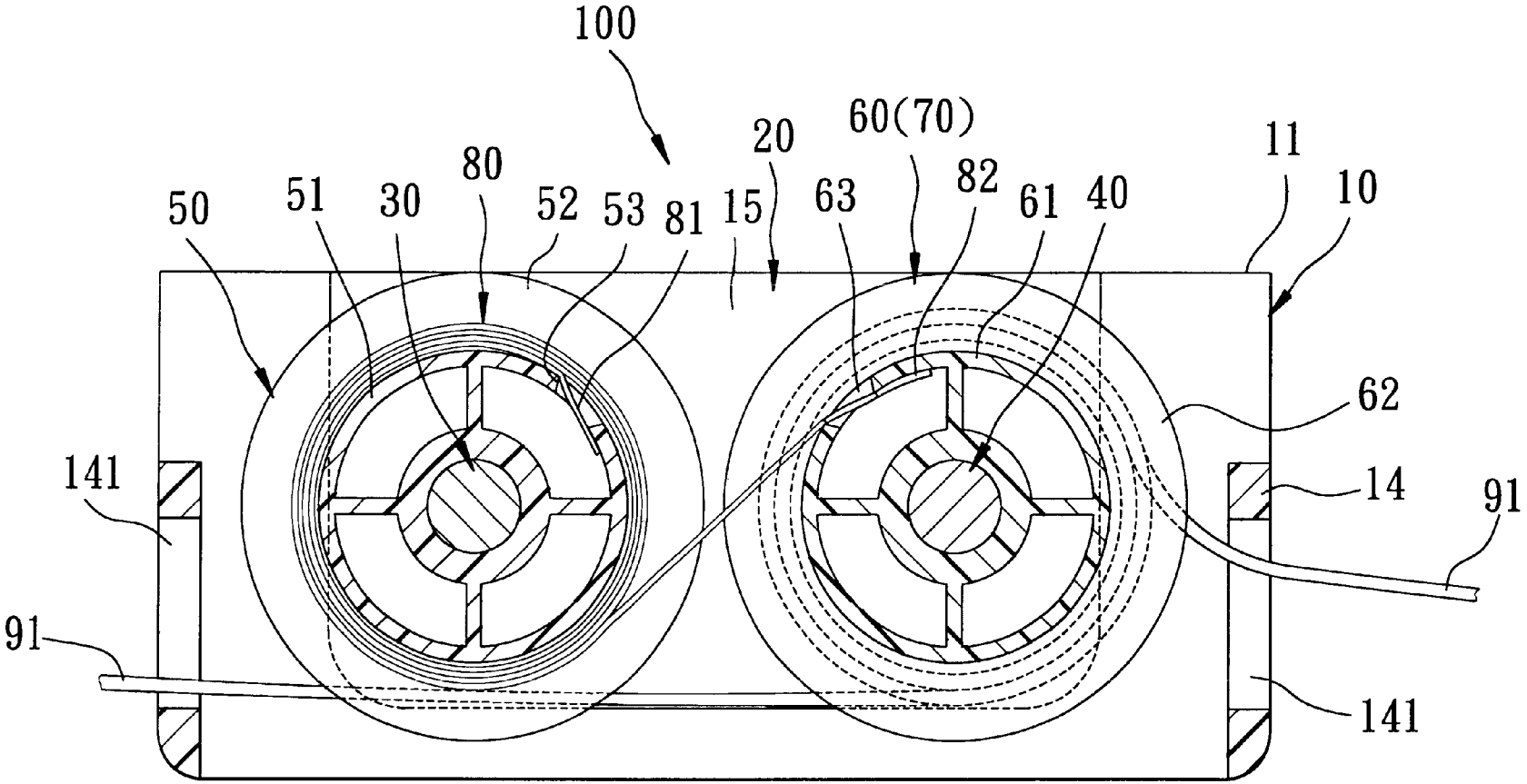
FIG. 3 is a cross-sectional side view of the preferred embodiment.
Figure 4:
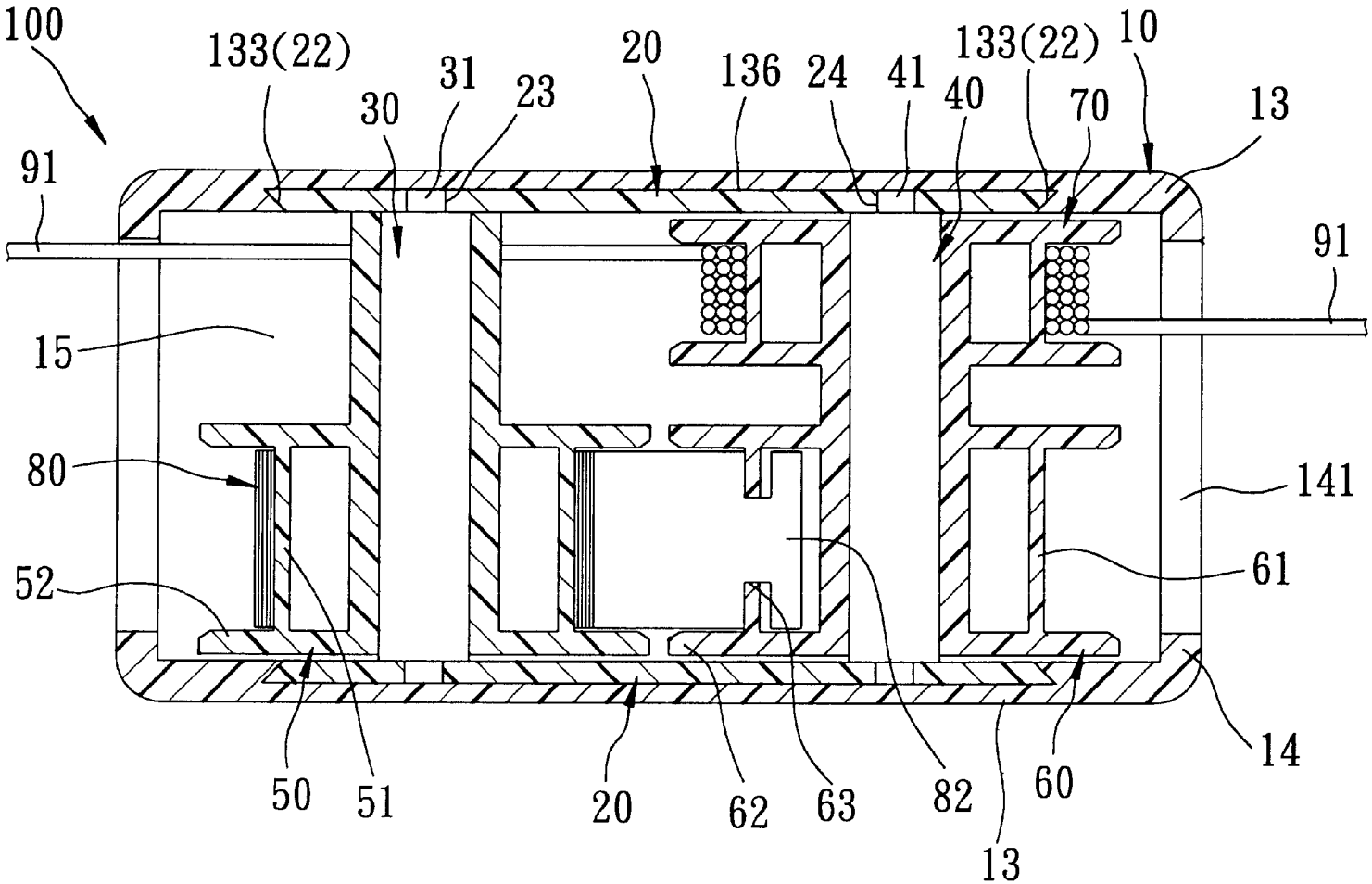
FIG. 4 is a cross-sectional top view of the preferred embodiment.

Referring to FIGS. 3 and 4, preferably, the upper ends of the lifting cords 91 are initially attached to the cord spool 70 in a conventional manner before assembly. During assembly of the spring motor assembly 100 of the present invention, the coil spring 80 is installed on the storage drum 50 by extending the first end 81 into the first engaging hole 53 to engage the storage drum 50 and by winding the coil spring 80 around the storage drum 50, which is then sleeved on the first axle 30. The assembly of the output drum 60 and the cord spool 70 is sleeved on the second axle 40. Then, the first and second axles 30, 40 are installed on the insert plates 20 by extending the pin projections 31, 41 into the first and second axle holes 23, 24, respectively. Thereafter, the insert plates 20 are inserted into the dovetail grooves, i.e., the insert grooves 134, via the upper ends 135 of the insert grooves 134 so as to dispose the storage drum 50, the output drum 60 and the cord spool 70 in the receiving chamber 15 of the bracket 10. Finally, the second end 82 of the coil spring 80 is drawn upwardly for engaging the second engaging hole 63 in the output drum 60, and the lifting cords 91 are extended out of the bracket 10 via the cord openings 141 in the side walls 14. After assembly, the insert plates 20 engage fittingly the insert grooves 134 so as to position the axles 30, 40, the storage drum 50, the output drum 60 and the cord spool 70 on the bracket 10.

Figure 5:
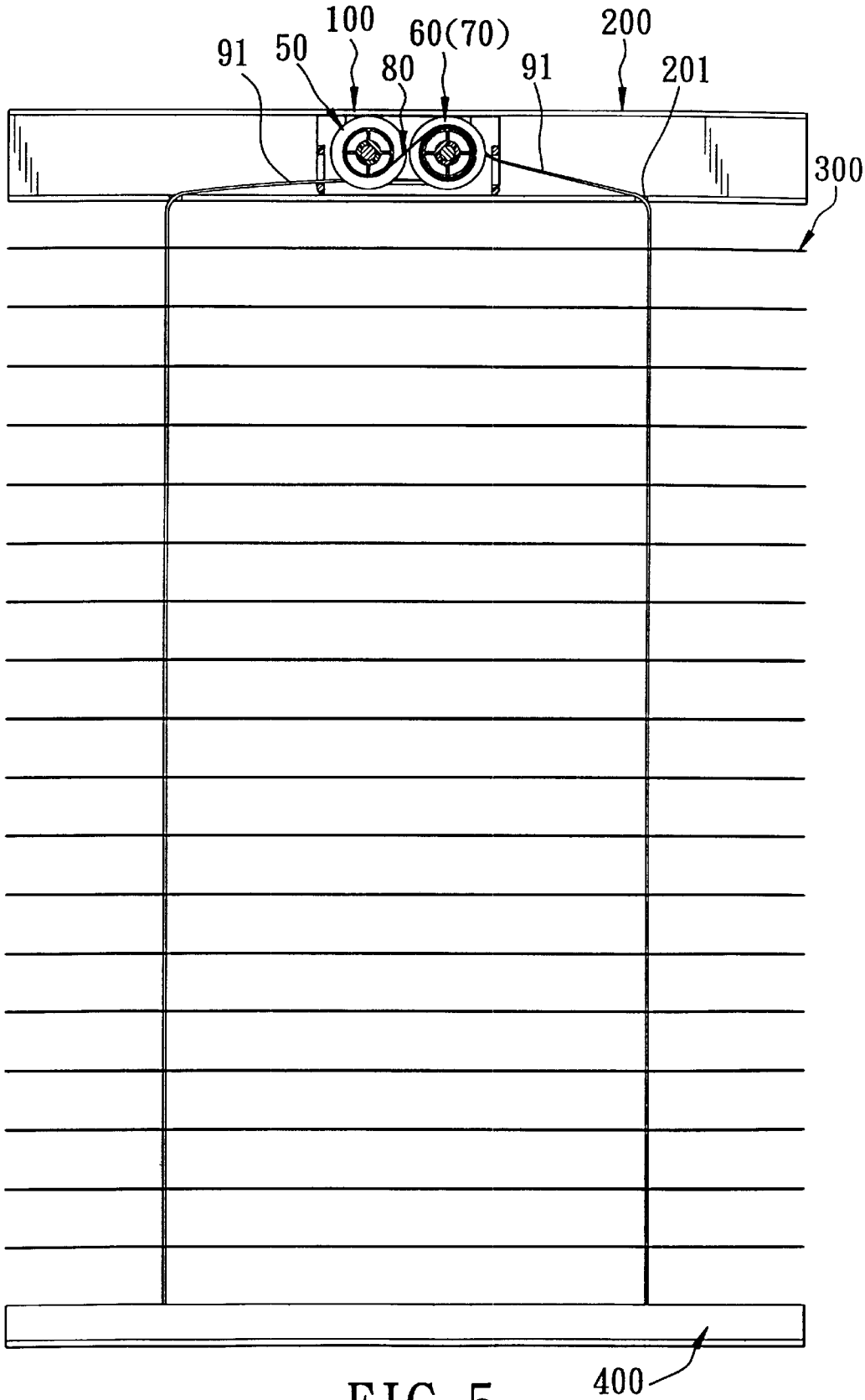
FIG. 5 is a schematic view of a Venetian blind that incorporates the spring motor assembly of the preferred embodiment.

Referring to FIG. 5, in practice, the spring motor assembly 100 of the present embodiment is mounted on a top rail 200 of a Venetian blind. The lifting cords 91 extend out of the top rail 200 via through holes 201 formed in a bottom wall of the top rail 200. The lifting cords 91 extend through a plurality of horizontal slats 300 that are suspended from the top rail 200. Lower ends of the lifting cords 91 are connected to a horizontal bottom bar 400 that is disposed below the slats 300. In use, when the bottom bar 400 is pulled downwardly for lowering the slats 300, the cord spool 70 and the output drum 60 are driven by the coil spring 80 to rotate in a direction for winding the coil spring 80 on the output drum 60 and for unwinding the lifting cord 91 from the cord spool 70. When the downward pulling force is removed while the bottom bar 400 reaches a desired altitude, the spring force of the coil spring 80 is just sufficient to maintain the bottom bar 400 at the desired position and to prevent dropping and self-raising of the bottom bar 400. When the pulling force is applied continuously to enable the slats 300 to reach the fully lowered position shown in FIG. 5, most of the coil spring 80 is wound around the output drum 60 with its first end 82 attached to the storage drum 50. On the other hand, when it is desired to raise the slats 20, the bottom bar 400 is urged upwardly, such as by applying an upward pushing force thereat. At this time, the cord spool 70 and the output drum 60 are driven by the coil spring 80 to rotate in another direction for winding the coil spring 80 on the storage drum 50 and for winding the lifting cords 91 on the cord spool 70. When the upward pushing force is removed while the slats 300 and the bottom bar 400 reach a desired position, the spring force of the coil spring 80 is just sufficient to maintain the bottom bar 400 at the desired position and to prevent self-raising and dropping of the bottom bar 400. When the bottom bar 400 is continuously urged upwardly to enable the slats 300 to reach the entirely raised position in which all of the slats 300 are accumulated on the bottom bar 400, the coil spring 80 is substantially transferred from the output drum 60 to the storage drum 50 with its second end 82 attached to the output drum 60. The orientation of the coil spring 80, as it is transferred from the output drum 60 to the storage drum 50, is reversed.

Note that each of the first and second axles 30, 40 engages the insert plates 20 at two opposite ends thereof. The insert plates 20 are inserted into the dovetail grooves 134 of the bracket 10. The entire construction of the spring motor assembly 100 is relatively firm and stable so as to support the weights of the slats 300 and the bottom bar 400 in order to ensure smooth raising and lowering movement of the slats 300 of the Venetian blind. In addition, without the need for a fastener, such as screws of rivets, the axles 30, 40 can be easily assembled to the insert plates 20, which, in turn, can be easily assembled to the bracket 10. The engagement between the axles 30, 40 and the insert plates 20 and between the insert plates 20 and the bracket 10 is relatively secure. Moreover, the bracket 10 may be designed to have a size and shape conforming with an interior cross-section of the top rail 200 such that the bracket 10 can be retained fittingly and securely in the top rail 200 without the need for using fastening screws.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A spring motor assembly for a Venetian blind having a top rail, a plurality of horizontal slats suspended from the top rail, a horizontal bottom bar disposed below the slats, and a pair of lifting cords, each of which extends through the slats and has an upper end extending into the top rail and a lower end connected to the bottom bar, said spring motor assembly comprising:

a bracket adapted to be installed on the top rail, said bracket including parallel front and back walls, and a pair of lateral side walls interconnecting said front and back walls and cooperating with said front and back walls to confine a receiving chamber with a top opening, each of said front and back walls having an inner wall surface that confronts the other of said front and back walls, said front and back walls further having upper edges that define said top opening, said inner wall surface of each of said front and back walls being formed with an insert groove that extends downwardly from said upper edge and that has an open upper end formed through said upper edge, each of said lateral side walls being formed with a cord opening communicated with said receiving chamber and adapted to permit extension of a respective one of the lifting cords therethrough;

a pair of insert plates, each of which is inserted into said insert groove in a respective one of said front and back walls via said open upper end and is retained thereon;

parallel first and second axles mounted on said insert plates and extending transversely between said insert plates;

a storage drum mounted rotatably on said first axle;

an output drum mounted rotatably on said second axle;

a cord spool mounted rotatably on said second axle and co-rotatable with said output drum, said cord spool being adapted to engage the upper ends of the lifting cords and to permit winding of the lifting cords therearound; and a coil spring having a first end engaging said storage drum and a second end opposite to said first end and engaging said output drum, said coil spring being wound around at least one of said storage drum and said output drum and being transferred from one of said storage drum and said output drum to the other of said storage drum and said output drum when the bottom bar of the Venetian blind is moved with respect to the top rail in a vertical direction.

2. The spring motor assembly as claimed in claim 1, wherein said insert plates are formed with aligned first axle holes and aligned second axle holes, said first axle having two opposite ends, each of which is formed with a pin projection that extends into and that engages said first axle hole in a respective one of said insert plates, said second axle having two opposite ends, each of which is formed with a pin projection that extends into and that engages said second axle hole in a respective one of said insert plates.

3. The spring motor assembly as claimed in claim 1, wherein said insert groove in each of said front and back walls of said bracket is a dovetail groove with an open narrower end proximate to the other of said front and back walls, and a wider end distal to the other of said front and back walls.

4. The spring motor assembly as claimed in claim 3, wherein said insert groove is defined by:

a pair of spaced-apart lateral faces which are inclined relative to said front and back walls, which have inner ends defining said narrower end of said dovetail groove and outer ends defining said wider end of said dovetail groove, and which have upper ends defining said open upper end of said insert groove, and lower ends opposite to said upper ends;

a connecting face extending between said outer ends of said lateral faces; and a horizontal bottom face that faces upwardly and that extends between said lower ends of said lateral faces.

* * * * *